United States Patent [19]

Andress, Jr.

[11] 4,072,618

[45] Feb. 7, 1978

[54] METAL WORKING LUBRICANT

[75] Inventor: Harry J. Andress, Jr., Wenonah, N.J.

[73] Assignee: Mobil Oil Corporation, New York, N.Y.

[21] Appl. No.: 718,222

[22] Filed: Aug. 27, 1976

[51] Int. Cl.[2] ..... C10M 1/48; C10M 3/42; C10M 5/24; C10M 7/46

[52] U.S. Cl. ..... 252/46.6; 72/42; 252/48.6; 252/56 S; 252/56 D

[58] Field of Search ..... 72/42; 252/46.6, 48.6, 252/56 S, 56 D

[56] References Cited

U.S. PATENT DOCUMENTS

| | | | |
|---|---|---|---|
| 2,628,974 | 2/1953 | Sanderson | 252/48.6 |
| 2,733,235 | 1/1956 | Cross et al. | 252/46.6 |
| 2,993,858 | 7/1961 | Sudholz | 252/32.7 R |
| 3,136,748 | 6/1964 | Miller et al. | 252/48.6 |
| 3,381,022 | 4/1968 | LeSuer | 260/404.8 |
| 3,403,102 | 9/1968 | LeSuer | 252/46.6 |
| 3,522,179 | 7/1970 | LeSuer | 252/56 D |

*Primary Examiner*—Delbert E. Gantz
*Assistant Examiner*—Irving Vaughn
*Attorney, Agent, or Firm*—Charles A. Huggett; Hastings S. Trigg

[57] ABSTRACT

A cutting oil composition comprises a major amount of mineral lubricating oil and minor amounts of (A) a sulfurized oil and (B) the reaction product of a polyalkenylsuccinic anhydride with a polyethyleneglycol or a polypropyleneglycol or such reaction product further reacted with sulfur or with phosphorus pentasulfide.

4 Claims, No Drawings

METAL WORKING LUBRICANT

BACKGROUND OF THE INVENTION

1. Field of the Invention

This invention relates to lubricants for metal working. It is more particularly concerned with cutting oil compositions.

2. Description of the Prior Art

It has been the practice heretofore to improve the film strength of cutting oils subject to extreme pressure by incorporating therein various compounds of sulfur, phosphorus, chlorine, metal, fatty materials, or combinations thereof. Insofar as is now known, it has not been proposed to incorporate a combination of sulfurized oil and the reaction product of a polyalkenylsuccinic anhydride with a polyalkylene glycol.

SUMMARY OF THE INVENTION

This invention provides a cutting oil composition comprising a mineral oil and minor amounts, sufficient to provide improved extreme pressure properties thereto, of (A) a sulfurized oil and (B) the reaction product of a polyalkenylsuccinic anhydride with a polyethyleneglycol or a polypropyleneglycol or said reaction product further reacted with sulfur or phosphorus pentasulfide.

DESCRIPTION OF SPECIFIC EMBODIMENTS

The sulfurized oils component (A) are those described in U.S. Pat. No. 2,993,858, to which reference is made. Suitable compounds are the "corrosive," sulfur-containing organic compositions in which sulfur is "loosely-bound" including the sulfurized animal, marine or vegetable oils containing from about 12 to about 20% by weight of sulfur; sulfurized mineral oils including the naphthenic and paraffinic oils containing up to about 5% of added sulfur; and sulfurized terpenes and mercaptans. Of particular utility are the corrosive, sulfurized lard and sperm oils containing from about 12 to about 20% and preferably about 15% by weight sulfur.

Also included are the so-called "non-corrosive" sulfurized substances which are characterized as "firmly-bound", as opposed to the "loosely-bound." These substances include sulfurized animal, marine and vegetable oils containing up to about 10% by weight of sulfur, such as sulfurized lard and sperm oils. The amount of component (A) that is added to the base mineral oil will be between about 1 weight percent and about 20 weight percent, preferably between about 1 weight percent and about 10 weight percent.

The other component (B) is the reaction product between a polyalkenylsuccinic anhydride and a polyethyleneglycol or a polypropyleneglycol. The polyalkenylsuccinic anhydrides are readily prepared by thermal or catalytic methods by reacting a polyolefin with maleic anhydride. The preparation of such adducts is well known in the art any many polyalkenylsuccinic anhydrides are available commercially. The polyalkenylsuccinic anhydride utilizable herein will have a molecular weight of between about 500 and about 2000.

The polyethyleneglycols and polypropyleneglycols are readily available commercially. Those utilizable in the present invention will have a molecular weight of between about 200 and about 1000.

In preparing the reaction products utilizable in the cutting oil compositions of this invention, the polyalkenylsuccinic anhydride is reacted with the polyethyleneglycol or polypropyleneglycol in a mole ratio of anhydride to glycol of between about 0.5 and about 2.0, preferably about 1.0. The reaction is carried out at temperatures between about 150° and about 300° C, preferably between about 200° and about 300° C. The reaction time will be between about 1 hour and about 10 hours. The amount of component (B) added to the base oil will be between about one weight percent and about 20 weight percent, preferably between about one weight percent and about 10 weight percent.

A wide variety of lubricating oils can be used as the base for the lubricants described herein, including solvent refined mineral oils. Suitably the above mentioned sulfurized mineral oils, preferably corrosive sulfurized mineral oils, may themselves be used as the base oil. In such a case, the base oil may contain from about 0.1% to about 5% by weight of "loosely bound" sulfur, prepared by sulfurizing a mineral oil (having a viscosity range of 40–300 SUS at 100° F) using known techniques.

In another embodiment of this invention, the additive (B) is the aforedescribed reaction product of polyalkenylsuccinic anhydride with polyethylene or polypropylene glycol (anhydride-glycol product) is further reacted with sulfur or phosphorus pentasulfide. In general, the amounts of sulfur or phosphorus pentasulfide used per part of anhydride-glycol product will be about 0.01–0.05 part sulfur or about 0.05–0.15 parts phosphorus pentasulfide, all parts being by weight. The reaction is carried out at temperatures of between 150° C. and about 250° C. for between about 5 hours and about 10 hours.

EXAMPLE 1

A mixture of 500 g. (0.33 mole) of polybutenyl succinic anhydride (M.W. = about 1500) and 200 g. (0.66 mole) of polyethylene glycol (M.W. = about 300) was heated with stirring and held at that temperature for about four hours. Filtration gave the final product.

EXAMPLE 2

A mixture of 1050 g. (0.70 mole) of polybutenylsuccinic anhydride (M.W. = about 1500) and 420 g. (0.70 mole) of polyethylene glycol (M.W. = about 600) was heated with stirring to about 275° C. and held at that temperature for about 2 hours. Filtration gave the final product.

EXAMPLE 3

A mixture of 368 g. (0.25 mole) of polybutenylsuccinic anhydride (M.W. = about 1472) and 150 g. (0.375 mole) of polypropylene glycol (M.W. = about 400) was heated with stirring to about 250° C. and held at that temperature for about 8 hours. Filtration gave the final product.

EXAMPLE 4

A mixture of 380 g. (0.5 mole) of an alkenyl (dimerized $C_{18}$ to $C_{26}$ 1-olefin mixture) succinic anhydride (M.W. = about 760) and 150 g. (0.5 mole) of polyethylene glycol (M.W. = about 300) was heated with stirring to about 250° C. and held at that temperature for about 3 hours. Filtration gave the final product.

EXAMPLE 5

A mixture of 1375 g. of a product prepared as described in Example 2 of 30 g. of powdered sulfur was stirred at about 200° C. for about 7 hours. Filtration gave the final product.

EXAMPLE 6

A mixture of 1158 g. of a product prepared as described in Example 2 and 111 g. of phosphorus pentasulfide was stirred at about 150° C. for about 7 hours. Filtration gave the final product.

TAPPING TEST

The ability of a cutting oil to operate efficiently is measured in the tapping test. In the tapping test, a series of holes is drilled in a test metal such as SAE 1020 hot-rolled steel. The holes are tapped in a drill press equipped with a table which is free to rotate about the center on ball bearings. A torque arm is attached to this "floating table" and the arm in turn activates a spring scale, so that the actual torque during the tapping, with the oil being evaluated, is measured directly. The same conditions used in evaluating the test oil are employed in tapping with a strong oil which has arbitrarily been assigned an efficiency of 100%. The average torque in the test oil is compared to that of the standard and a relative efficiency is calculated on a percentage basis. For example, Torque with standard reference oil—19.3
Torque with test oil—19.8
Relative efficiency of test oil—19.3/19.8 × 100 = 97.4

This test is described by C. D. Flemming and L. H. Sudholz in Lubrication Engineering, volume 12, No. 3, May–June 1956, pages 199 to 203.

A base oil comprising a paraffinic mineral oil having a viscosity of 150 SUS at 100° F. and 3 weight percent sulfurized lard oil (15% sulfur) was subjected to the tapping test. Also, blends of the base oil with each of the products of Examples 1 through 6 (Component B) were prepared and subjected to the tapping. Pertinent data are set forth in the following Table.

TABLE

| Oil | Component B Product of | Conc., Wt. % | Tapping Efficiency, % |
|---|---|---|---|
| Base Oil | None | — | 87 |

TABLE-continued

| Oil | Component B Product of | Conc., Wt. % | Tapping Efficiency, % |
|---|---|---|---|
| Base Oil | Example 1 | 3 | 114 |
| Base Oil | Example 2 | 3 | 109 |
| Base Oil | Example 3 | 3 | 101 |
| Base Oil | Example 4 | 3 | 118 |
| Base Oil | Example 5 | 3 | 117 |
| Base Oil | Example 6 | 3 | 100 |

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A cutting oil composition consisting essentially of a mineral oil and minor amounts, sufficient to provide improved extreme pressure properties thereto, of a component (A) a sulfurized oil and a component (B) the reaction product of a polyalkylenesuccinic anhydride having a molecular weight between about 500 and about 2000 with a polyethyleneglycol or a polypropyleneglycol, having a molecular weight between about 200 and about 1000, in a mole ratio of anhydride to glycol between about 0.5 and about 2, at a temperature between about 150° and about 300° C. for between about 1 hour and about 10 hours to form an intermediate product; and further reacting with said intermediate about 0.01–0.05 part by weight sulfur or about 0.05–0.15 part by weight phosphorus pentasulfide per part by weight intermediate, at a temperature between about 150° and about 250° C. for between about 5 hours and about 10 hours.

2. The cutting oil composition of claim 1 wherein component (A) is a sulfurized lard oil containing 15% sulfur and component (B) is the reaction product of a polyalkenylsuccinic anhydride with a polyethyleneglycol.

3. The cutting oil composition of claim 2 wherein said polyalkenylsuccinic anhydride is polybutenylsuccinic anhydride.

4. The cutting oil composition of claim 3 wherein said polybutenylsuccinic anhydride has a molecular weight of about 1500 and polyethyleneglycol has a molecular weight of about 600 and the mole ratio of polybutenylsuccinic anhydride to polyethyleneglycol is 1.0.

* * * * *